US011556080B2

(12) United States Patent
Munetsugu et al.

(10) Patent No.: US 11,556,080 B2
(45) Date of Patent: Jan. 17, 2023

(54) IMAGE FORMING SYSTEM

(71) Applicant: CANON KABUSHIKI KAISHA, Tokyo (JP)

(72) Inventors: Hiroyuki Munetsugu, Kanagawa (JP); Shohei Katsuya, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/535,480

(22) Filed: Nov. 24, 2021

(65) Prior Publication Data

US 2022/0082960 A1 Mar. 17, 2022

Related U.S. Application Data

(63) Continuation of application No. 17/320,034, filed on May 13, 2021, now Pat. No. 11,215,940.

(30) Foreign Application Priority Data

May 22, 2020 (JP) ..... JP2020-089814

(51) Int. Cl.
*G03G 15/08* (2006.01)

(52) U.S. Cl.
CPC ..... *G03G 15/0886* (2013.01); *G03G 15/0867* (2013.01); *G03G 2215/0692* (2013.01)

(58) Field of Classification Search
CPC ..... G03G 15/0865; G03G 15/0867; G03G 15/0886; G03G 15/0896; G03G 21/1647; G03G 21/1676; G03G 2215/0692
See application file for complete search history.

(56) References Cited

U.S. PATENT DOCUMENTS

| | | | | |
|---|---|---|---|---|
| 6,332,065 | B1 * | 12/2001 | Howard | G03G 15/0867 222/DIG. 1 |
| 2014/0376971 | A1 * | 12/2014 | Tanaka | G03G 15/0886 399/260 |
| 2016/0109827 | A1 * | 4/2016 | Yoshida | G03G 15/0886 399/260 |
| 2018/0120734 | A1 * | 5/2018 | Kitagawa | G03G 15/0886 |
| 2018/0181026 | A1 * | 6/2018 | Mimura | G03G 21/1647 |
| 2021/0124284 | A1 * | 4/2021 | Hayashida | G03G 15/0867 |

* cited by examiner

*Primary Examiner* — Sophia S Chen
(74) *Attorney, Agent, or Firm* — Canon U.S.A., Inc. IP Division

(57) ABSTRACT

An image forming system includes a toner container and an image forming apparatus, the toner container including a first toner containing portion, a container base portion having a discharge port for discharging toner, and a container shutter that is moved between open and closed positions and includes an engaged portion, wherein the image forming apparatus includes a main body base portion that detachably attaches the toner container and has a receiving port for receiving the toner and, a second toner containing portion, a movable member that is moved between first and second positions and includes an engaging portion that engages with the engaged portion, a regulating member that is moved between a regulation position and a regulation release position, and an urging member that urges the movable member to move from the first position to the second position when the regulating member is located at the regulation release position.

7 Claims, 14 Drawing Sheets

IMAGE FORMING SYSTEM

CROSS-REFERENCE TO RELATED APPLICATIONS

This is a continuation application of U.S. patent application Ser. No. 17/320,034, filed on May 13, 2021, which claims the benefit of Japanese Patent Application No. 2020-089814 filed May 22, 2020, all of which are hereby incorporated by reference in their entirety.

BACKGROUND

Field of the Disclosure

The present disclosure relates to an electrophotographic image forming system.

Description of the Related Art

There is known an electrophotographic image forming system having a configuration in which a toner container that contains toner and includes a discharge port for discharging the toner and a shutter for closing and opening the discharge port is mounted on a development unit and the toner is supplied to the development unit. Regarding this configuration, there is known a technique in which the shutter of the toner container is moved from a closed position to an open position when a user performs an operation to mount the toner container on the development unit, as discussed in Japanese Patent Application Laid-Open No. 2009-175760.

SUMMARY

According to an aspect of the present disclosure, an image forming system includes a toner container and an image forming apparatus. The toner container includes a first toner containing portion containing toner therein, a container base portion provided with a discharge port through which the toner contained in the first toner containing portion is discharged to an outside of the first toner containing portion, and a container shutter configured to be moved between an open position where the discharge port is opened and a closed position where the discharge port is closed with respect to the container base portion, the container shutter including an engaged portion. The image forming apparatus includes a main body base portion to which the toner container is detachably attached and which is provided with a receiving port for receiving the toner discharged from the discharge port of the toner container, a second toner containing portion for containing the toner received by the receiving port, a movable member configured to be moved between a first position and a second position with respect to the main body base portion, the movable member including an engaging portion configured to engage with the engaged portion of the container shutter, a regulating member configured to be moved between a regulation position for regulating a movement of the movable member from the first position to the second position and a regulation release position for releasing the regulation of the movement of the movable member, the regulating member being at the regulation position in a first state where the toner container is not attached to the main body base portion and being at the regulation release position in a second state where the toner container is attached to the main body base portion, and an urging member configured to urge the movable member to move from the first position to the second position when the regulating member is located at the regulation release position. The container shutter is configured to be moved with the movable member when the engaged portion is engaged with the engaging portion of the movable member, thereby allowing the container shutter to be at the closed position while the movable member is at the first position and to be at the open position while the movable member is at the second position.

Further features of the present disclosure will become apparent from the following description of exemplary embodiments with reference to the attached drawings.

DESCRIPTION OF THE EMBODIMENTS

Exemplary embodiments of the present disclosure will be described below with reference to the drawings.

Figure 1:
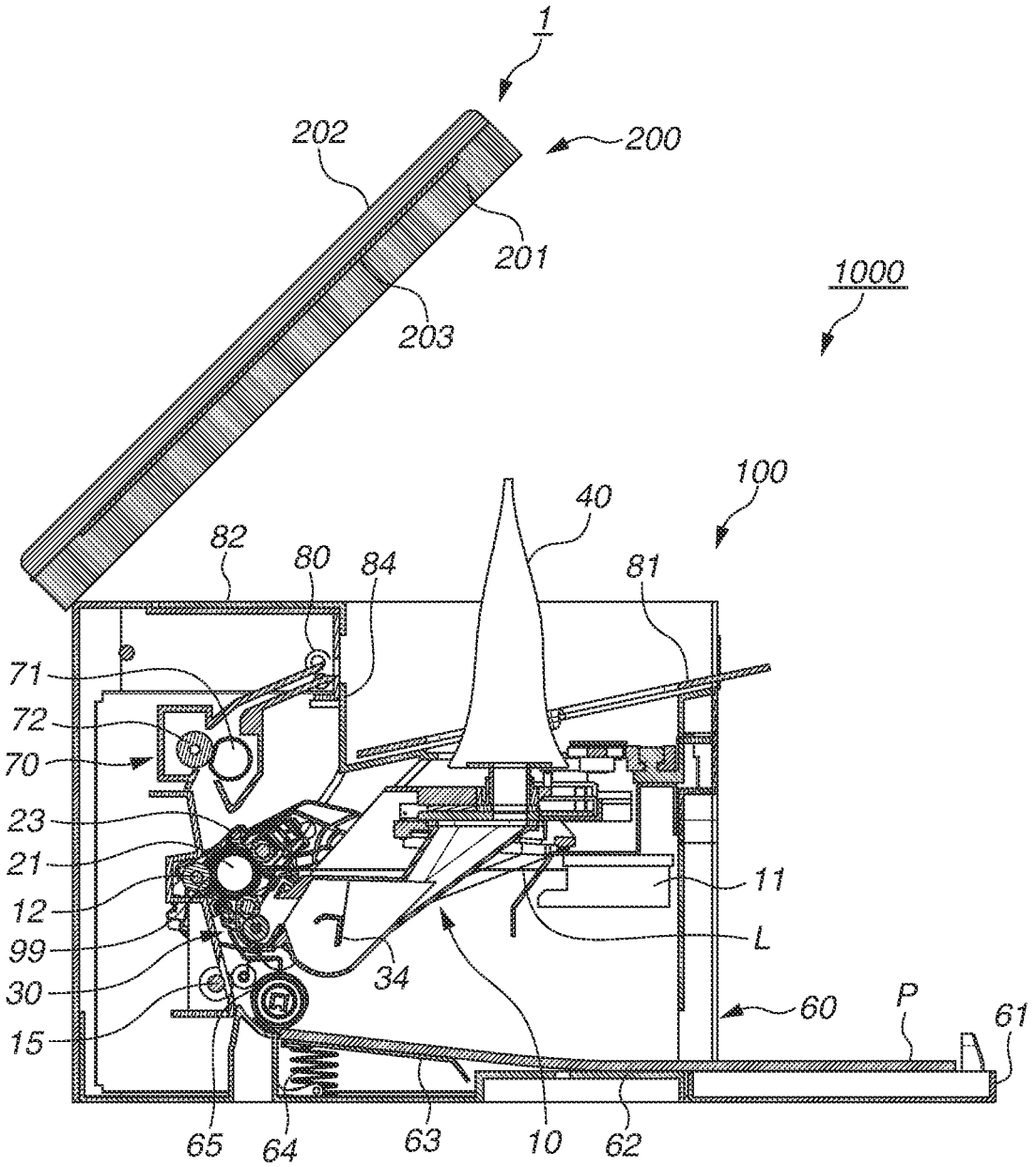
FIG. 1 is a schematic sectional view illustrating an image forming apparatus according to a first exemplary embodiment.
Figure 2A:
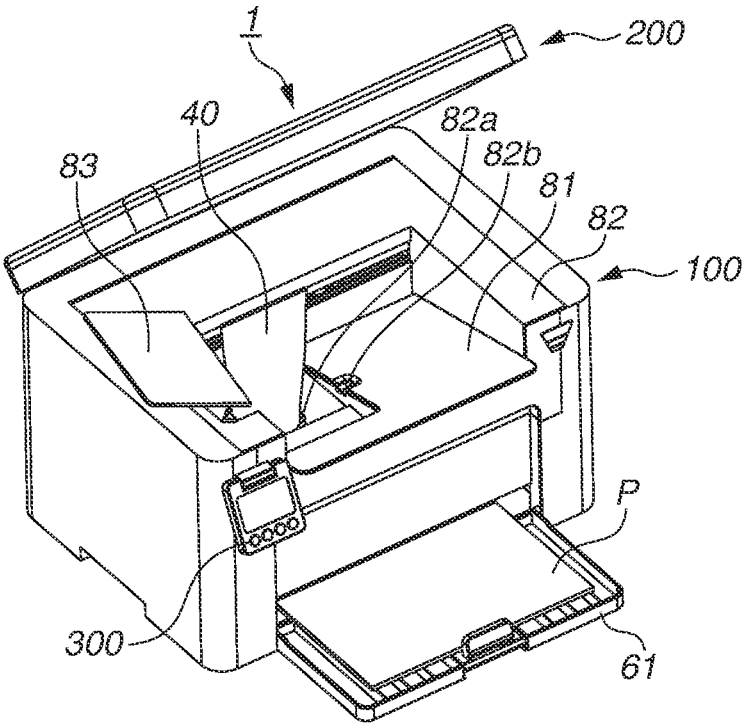
FIG. 2A is a perspective view illustrating the image forming apparatus in a state where a toner container is mounted, according to one or more exemplary embodiment.
Figure 2B:
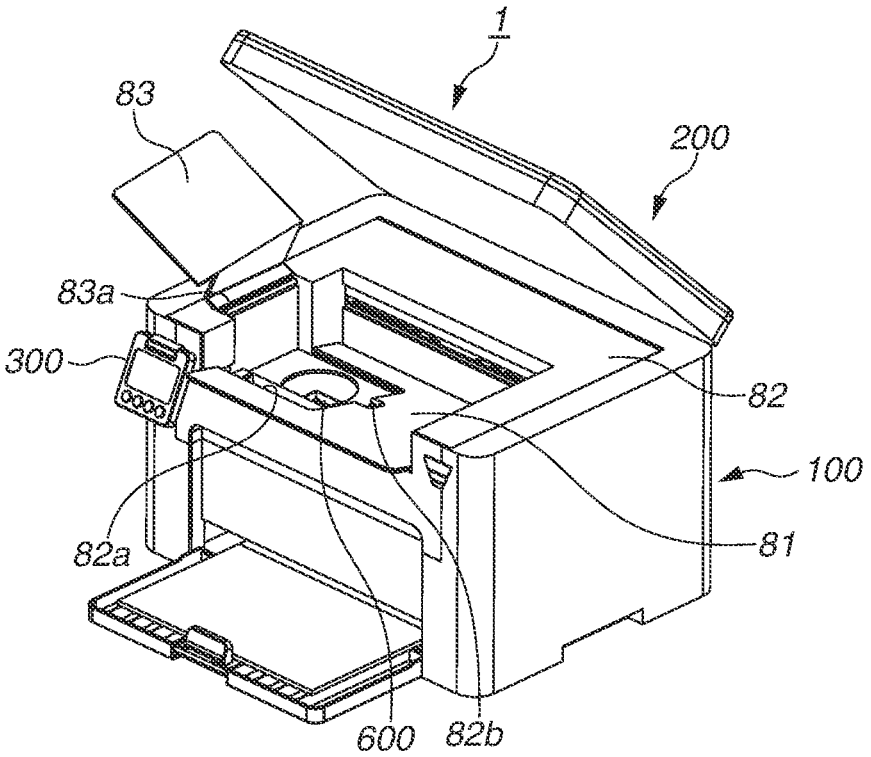
FIG. 2B is a perspective view illustrating the image forming apparatus in a state where the toner container is not mounted, according to one or more exemplary embodiment.

FIG. 1 is a schematic sectional view illustrating an image forming apparatus 1 according to a first exemplary embodiment. FIG. 2A is a perspective view illustrating the image forming apparatus 1 in a state where a toner container 40 is mounted. FIG. 2B is a perspective view illustrating the image forming apparatus 1 in a state where the toner container 40 illustrated in FIG. 1 is not mounted.

Overall Configuration

The image forming apparatus 1 is a black-and-white printer that forms a toner image on a recording material P based on image information input from an external apparatus.

As illustrated in FIG. 1, the image forming apparatus 1 includes an apparatus main body 100 and a reading apparatus 200 that is openably and closably supported by the apparatus main body 100. In addition, the toner container 40 is mounted on the image forming apparatus 1. The image forming apparatus 1 and the toner container 40 constitute an image forming system 1000.

The apparatus main body 100 roughly includes a feed unit 60, an image forming unit 10, a fixing unit 70, and a discharge unit 80. These units will be described in detail next.

Image Forming Unit

Figure 3:
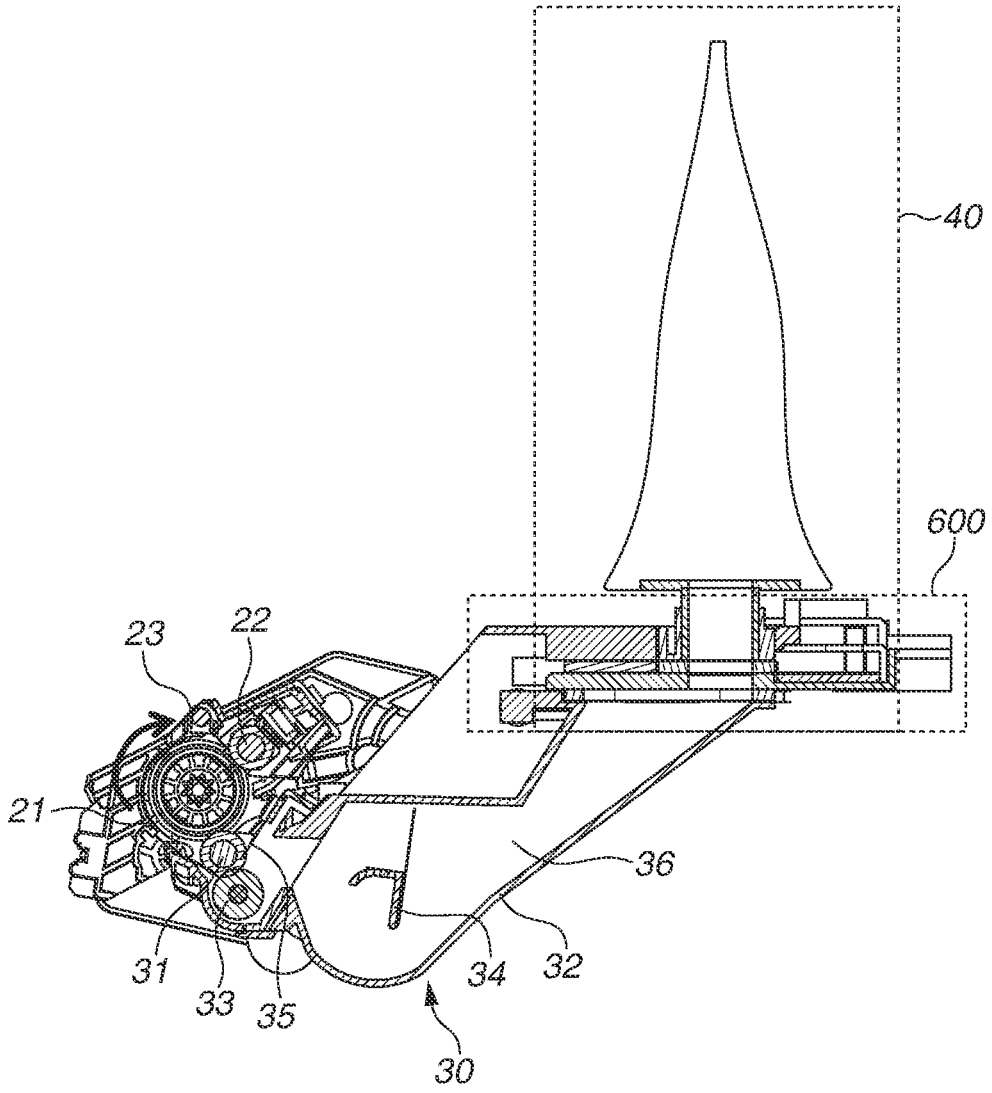
FIG. 3 is an enlarged sectional view illustrating the toner container and a development unit, according to one or more exemplary embodiment.

A configuration of the image forming unit 10 will be described. FIG. 3 is an enlarged sectional view illustrating the toner container 40 and a part of the image forming unit 10 including a mounting portion 600. The image forming unit 10 includes a scanner unit 11 (see FIG. 1) serving as an exposure unit, a photosensitive drum 21 serving as an image carrying member, a pre-exposure unit 23, a charge roller 22 serving as a charge member, a development unit 30, and a transfer roller 12 (see FIG. 1). The photosensitive drum 21 is a photosensitive member formed in a cylindrical shape. The photosensitive drum 21 according to the present exemplary embodiment includes a photosensitive layer formed of an organic photosensitive member with negative chargeability on a drum-like base formed of aluminum. The photosensitive drum 21 is rotationally driven at a predetermined process speed in a predetermined direction (clockwise direction viewed from FIG. 3) by a motor (not illustrated).

The charge roller 22 makes contact with the photosensitive drum 21 with a predetermined contact pressure and forms a charging portion. A desired charging voltage is applied to the charge roller 22 by a charging high-voltage power source, so that the surface of the photosensitive drum 21 is uniformly charged to a predetermined potential. In the present exemplary embodiment, the photosensitive drum 21 is charged to a negative polarity by the charge roller 22.

In order to produce a stable discharge in the charging portion, the pre-exposure unit 23 uniformly neutralizes the surface of the photosensitive drum 21 before reaching the charging portion.

The scanner unit 11 (see FIG. 1) irradiates the photosensitive drum 21 with laser light L corresponding to image information input from an external apparatus or the reading apparatus 200 by using a polygon mirror, so that scanning exposure is performed on the surface of the photosensitive drum 21. This exposure allows an electrostatic latent image corresponding to the image information to be formed on the surface of the photosensitive drum 21. The scanner unit 11 is not limited to a laser scanner device. For example, a light-emitting diode (LED) exposure device including an LED array in which a plurality of LEDs is arranged in a longitudinal direction of the photosensitive drum 21 may be adopted.

The development unit 30 includes a development roller 31 serving as a developer carrying member that carries a developer, a development container 32 serving as the frame of the development unit 30, and a supply roller 33 capable of supplying a developer to the development roller 31. The development roller 31 and the supply roller 33 are rotatably supported by the development container 32. The development roller 31 is disposed at an opening of the development container 32 so as to face the photosensitive drum 21. The supply roller 33 is rotatably in contact with the development roller 31, and toner serving as a developer and contained in the development container 32 is carried on the surface of the development roller 31 by the supply roller 33. The supply roller 33 may be excluded as long as toner can be sufficiently supplied to the development roller 31.

The development unit 30 according to the present exemplary embodiment uses a contact development method as a development method. More specifically, a toner layer carried on the surface of the development roller 31 makes contact with the photosensitive drum 21 in a development portion (area) where the photosensitive drum 21 and the development roller 31 face each other. A development voltage is applied to the development roller 31 by a development high-voltage power source (not illustrated). In a state where the development voltage is applied to the development roller 31, the toner carried on the development roller 31 is transferred from the development roller 31 onto the surface of the photosensitive drum 21 based on a potential distribution on the surface of the photosensitive drum 21, so that the electrostatic latent image is developed into a toner image. In the present exemplary embodiment, a reversal development method is adopted. More specifically, the surface of the photosensitive drum 21 is charged in a charging process and then exposed to light in an exposure process to allow toner to adhere to an area in the surface of the photosensitive drum 21 where the amount of charge has attenuated. As a result, a toner image is formed on the surface of the photosensitive drum 21.

In the present exemplary embodiment, toner having a particle size of 6 μm and having a negative polarity as a normal charging polarity is used. In the present exemplary embodiment, for example, polymerized toner generated by a polymerization method is adopted. Toner used in the present exemplary embodiment is a non-magnetic one-component developer that does not contain any magnetic components and is carried on the surface of the development roller 31 mainly by an intermolecular force and an electrostatic force (image force). Alternatively, a one-component developer containing magnetic components may be used. The one-component developer may include not only toner particles, but also an additive (e.g., wax or silica microparticles) for adjusting the fluidity or charging performance of toner. Further alternatively, a two-component developer composed of non-magnetic toner and carrier having magnetic properties may be used as a developer. In the case of using a developer having magnetic properties, for example, a cylindrical development sleeve inside which a magnet is disposed is used as the developer carrying member.

In the development container 32, a toner containing portion 36 serving as a second toner containing portion for containing toner, and a stirring member 34 disposed inside the toner containing portion 36 are provided. The stirring member 34 is configured to be driven and rotated by a motor (not illustrated) to stir the toner in the toner containing portion 36 and supply the toner to the development roller 31 and the supply roller 33. In addition, the stirring member 34 functions to circulate in the development container 32 the toner that is not used in the development and is scraped off from the surface of the development roller 31, and to make the toner in the development container 32 uniform. The stirring member 34 is not necessarily configured to be rotated. For example, a stirring member configured to swing may be adopted.

In the opening of the development container 32 at which the development roller 31 is disposed, a development blade 35 that regulates the amount of toner carried on the development roller 31 is disposed. The toner supplied onto the surface of the development roller 31 passes through a portion opposed to the development blade 35 along with the rotation of the development roller 31, so that the toner is uniformly formed into a thin layer and is charged to the negative polarity by triboelectric charging.

The transfer roller 12 forms a transfer nip portion 99 (see FIG. 1) for transferring the toner image formed on the surface of the photosensitive drum 21 onto the recording material P while making contact with the photosensitive drum 21 and conveying the recording material P.

Feed Unit

As illustrated in FIG. 1, the feed unit 60 includes a front door 61, a tray portion 62, a middle plate 63, a tray spring 64, and a pickup roller 65. The front door 61 is openably and closably supported by the apparatus main body 100. When the front door 61 is opened, a space for accommodating the recording material P appears. The tray portion 62 constitutes a bottom surface that forms this space. The middle plate 63 is supported by the tray portion 62 so as to be movable up and down. The tray spring 64 urges the middle plate 63 upward and presses the recording material P stacked on the middle plate 63 against the pickup roller 65. The front door 61 encloses the space for accommodating the recording material P in a state where the front door 61 is closed with respect to the apparatus main body 100, and supports the recording material P together with the tray portion 62 and the middle plate 63 in a state where the front door 61 is opened with respect to the apparatus main body 100.

Fixing Unit

The fixing unit 70 performs a fixation process for heating and melting the toner on the recording material P to fix the toner image to the recording material P. The fixing unit 70 includes a fixing film 71, a ceramic heater (not illustrated) for heating the fixing film 71, a thermistor (not illustrated) for detecting the temperature of the heater, and a pressure roller 72 that is brought into pressure contact with the fixing film 71 through the heater.

Image Forming Process

An image forming operation performed by the image forming unit 10 of the image forming apparatus 1 will be described with reference to FIGS. 1 and 3. When an image forming instruction is input to the image forming apparatus 1, the image forming process is started by the image forming unit 10 based on the image information input from an external computer or the reading apparatus 200 connected to the image forming apparatus 1. The scanner unit 11 applies the laser light L to the photosensitive drum 21 based on the input image information. The photosensitive drum 21 has been preliminarily charged by the charge roller 22, and thus the application of the laser light L to the photosensitive drum 21 allows an electrostatic latent image to be formed on the surface of the photosensitive drum 21. Toner is then supplied from the development roller 31 to the photosensitive drum 21 to develop the electrostatic latent image, so that a toner image is formed on the surface of the photosensitive drum 21.

In parallel with the image forming process performed by the image forming unit 10 described above, the pickup roller 65 of the feed unit 60 feeds the recording material P on the tray portion 62 to a registration roller pair 15. The recording material P fed by the pickup roller 65 hits a nip portion of the registration roller pair 15, so that the skew of the recording material P is corrected. The registration roller pair 15 is then driven based on the timing of when the toner image is transferred onto the recording material P at the transfer nip portion 99, and conveys the recording material P to the transfer nip portion 99.

A transfer voltage is applied to the transfer roller 12 from a transfer high-voltage power source (not illustrated), and the toner image carried on the surface of the photosensitive drum 21 is transferred onto the recording material P conveyed by the registration roller pair 15. The recording material P to which the toner image has been transferred is conveyed to the fixing unit 70, and the toner image is heated and pressurized while the recording material P passes through a fixing nip portion formed by the fixing film 71 and the pressure roller 72 of the fixing unit 70. As a result, the toner particles are melted and then fixed, so that the toner image is fixed to the recording material P. The recording material P that has passed through the fixing unit 70 is discharged to the outside of the image forming apparatus 1 by the discharge unit (discharge roller pair) 80, and is stacked on a discharge tray 81 formed at the upper portion of the apparatus main body 100 and serving as a stacking unit.

The discharge tray 81 is inclined upward toward the downstream side in the discharge direction of the recording material P. The recording material P discharged to the discharge tray 81 slides down the discharge tray 81, so that the trailing edge of the recording material P is aligned by a regulating surface 84.

The reading apparatus 200 includes a reading unit 201 in which a reading portion (not illustrated) is incorporated, and a pressing plate 202 that is openably and closably supported by the reading unit 201. The top surface of the reading unit 201 is provided with a platen glass 203 through which light emitted from the reading portion passes and on which a document is placed.

In a case where an image on a document is read by the reading apparatus 200, a user places the document on the platen glass 203 in a state where the pressing plate 202 is open. The user then closes the pressing plate 202 to prevent misregistration of the document on the platen glass 203, and outputs a reading instruction to the image forming apparatus 1 by, for example, operating an operation unit 300 (see FIGS. 2A and 2B). When a reading operation is started, the reading portion in the reading unit 201 reciprocates in a sub-scanning direction, i.e., a left-right direction in a state where the operation unit 300 of the image forming apparatus 1 faces the front side. In the reading portion, light emitted from a light-emitting portion and reflected on the document is received and photoelectrically converted by a light-receiving portion, so that the image on the document is read. In the following description, the front-back direction, the left-right direction, and the up-down direction are defined based on the state where the operation unit 300 faces the front side.

As illustrated in FIGS. 2A and 2B, a top cover 82 serving as a stacking tray is provided at the upper portion of the apparatus main body 100, and the discharge tray 81 serving as a stacking surface is formed on the upper surface of the top cover 82. On the top cover 82, an opening/closing member 83 is openably and closably supported about a rotation axis 83*a* extending in the front-back direction. The discharge tray 81 of the top cover 82 is provided with an opening 82*a* that is opened upward.

The opening/closing member 83 is configured to move between a closed position where a supply port 32*a* (see FIG. 7B) is covered to prevent the toner container 40 from being mounted on the development container 32 and an open position where the supply port 32*a* is exposed to the outside so that the toner container 40 can be mounted on the development container 32. The opening/closing member 83 at the closed position functions as a part of the discharge tray 81. The opening/closing member 83 and the opening 82*a* are formed on the left side of the discharge tray 81. When the user hooks his/her finger at a groove portion 82*b* provided in the top cover 82, the opening/closing member 83 is opened in the left direction. The opening/closing member 83 is formed substantially in an L-shape along the shape of the top cover 82.

The opening 82*a* of the discharge tray 81 is opened so that the mounting portion 600 formed at the upper portion of the development container 32 is exposed to the outside. When the opening/closing member 83 is opened, the user can access the mounting portion 600 without opening the top cover 82. In the present exemplary embodiment, a method in which the toner container 40 (see FIGS. 1 and 3) is mounted on the mounting portion 600 that is a part of the development unit 30, and toner is supplied directly to the development unit 30 (development container 32) is adopted. The toner container 40 is mounted on the mounting portion 600 of the image forming apparatus 1 in a state where at least a part of the toner container 40 is exposed to the outside.

Using the above-described configuration eliminates the need to replace the entire development unit 30 including the toner containing portion 36 (see FIG. 3), thereby achieving excellent usability. In addition, there is no need to replace process components such as various types of rollers, which leads to a reduction in cost.

Configuration of Toner Container

Figure 4A:
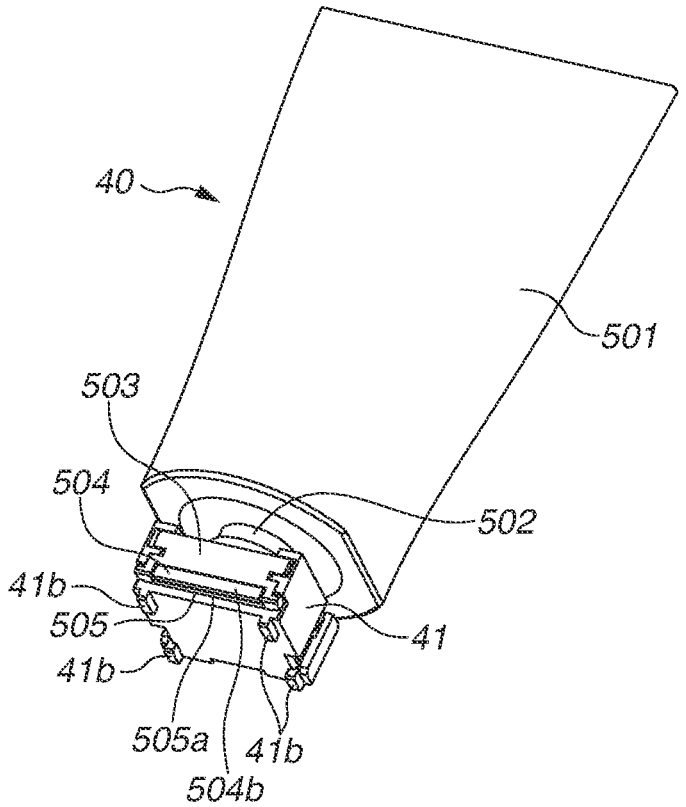
FIG. 4A is a perspective view illustrating the toner container with a container shutter closed, according to one or more exemplary embodiment.
Figure 4B:
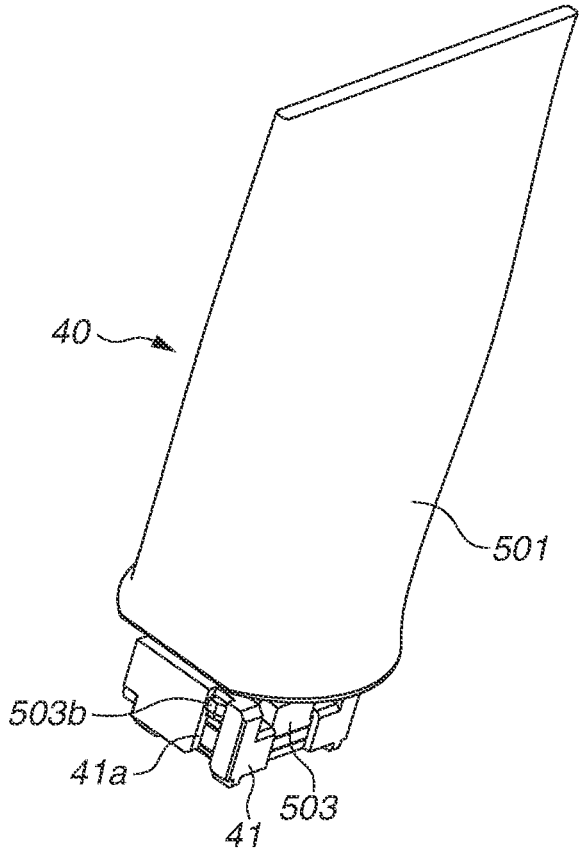
FIG. 4B is a perspective view illustrating the toner container viewed from a viewpoint different from that in FIG. 4A, according to one or more exemplary embodiment.
Figure 5A:
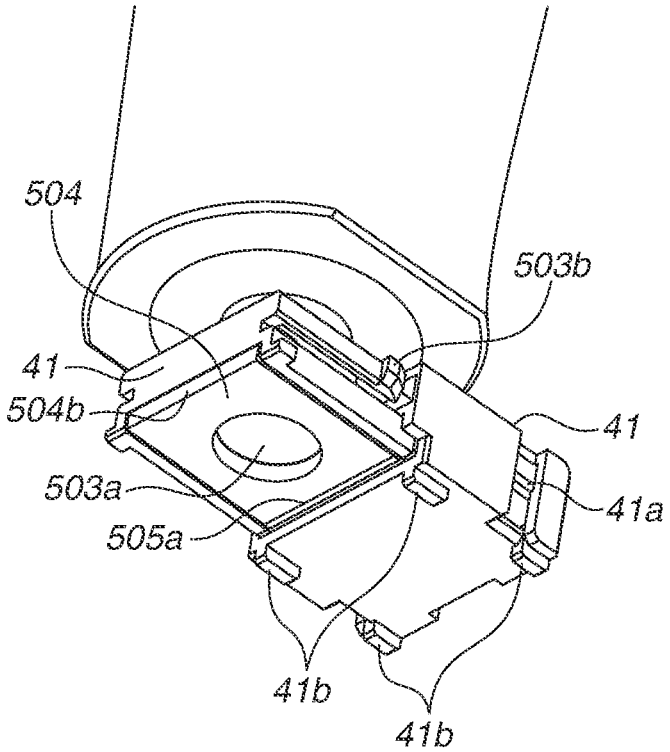
FIG. 5A is a perspective view illustrating the toner container with the container shutter open, according to one or more exemplary embodiment.
Figure 5B:
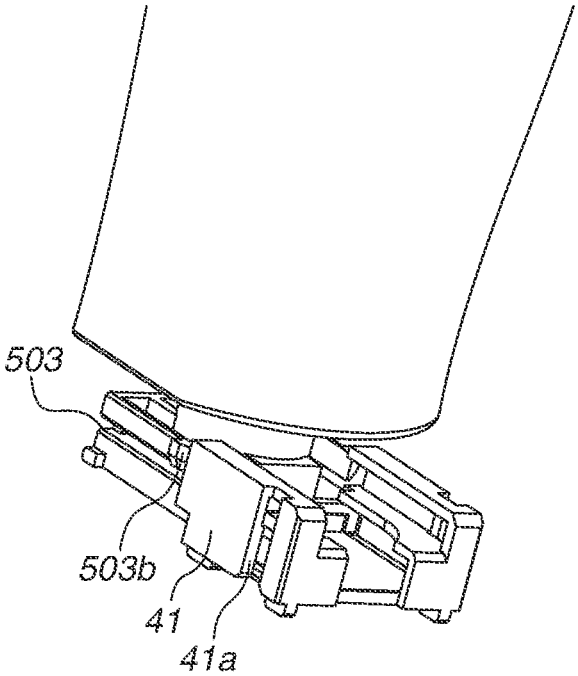
FIG. 5B is a perspective view illustrating the toner container viewed from a viewpoint different from that in FIG. 5A, according to one or more exemplary embodiment.
Figure 6:
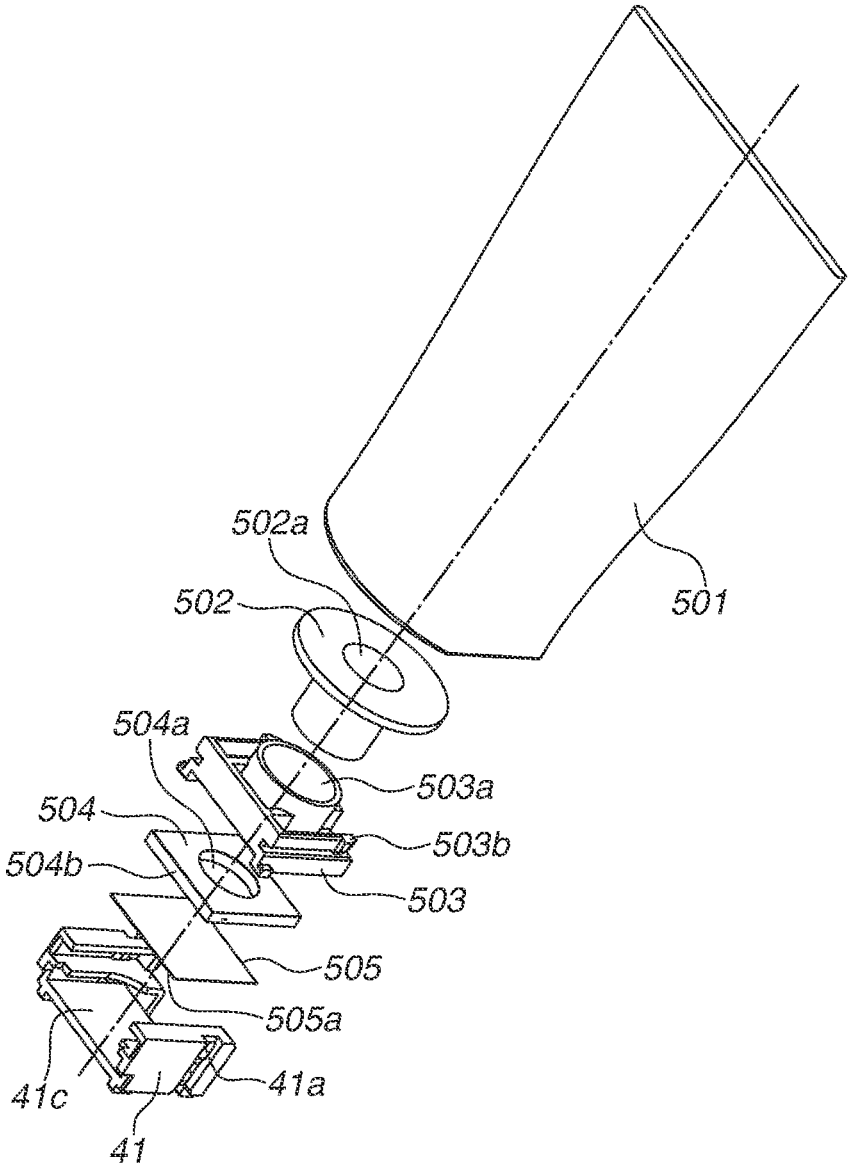
FIG. 6 is an exploded perspective view of the toner container, according to one or more exemplary embodiment.

The toner container 40 that is attachable to or detachable from the image forming apparatus 1 will be described next. FIG. 4A is a perspective view illustrating the toner container 40 with a container shutter 41 closed. FIG. 4B is a perspective view illustrating the toner container 40 viewed from a viewpoint different from that in FIG. 4A. FIG. 5A is a perspective view illustrating the toner container 40 with the container shutter 41 open. FIG. 5B is a perspective view illustrating the toner container 40 viewed from a viewpoint different from that in FIG. 5A. FIG. 6 is an exploded perspective view of the toner container 40.

As illustrated in FIG. 6, the toner container 40 includes a pouch 501, a nozzle 502, a container base portion 503, a container seal 504, a container sheet 505, and the container shutter 41.

The pouch 501 serving as a first toner containing portion is a flexible container, and is configured so that toner contained in the pouch 501 can be easily discharged to the outside of the pouch 501 when the user presses the pouch 501 from the outside or squeezes the pouch 501. The pouch 501 is formed of a material, for example, resin such as polyethylene, polypropylene, or polyethylene terephthalate, a composite material thereof, non-woven cloth, cloth, or paper.

While the pouch 501 is used in the present exemplary embodiment, a bottle or a paper bag may be used.

The nozzle 502 includes a discharge port 502*a* for discharging the toner contained in the pouch 501. The pouch 501 is joined to the nozzle 502 with an adhesive such as a hot-melt adhesive or by thermal welding.

The container base portion 503 includes an opening 503*a* in which a part of the nozzle 502 is accommodated. The discharge port 502*a* of the nozzle 502 is exposed, through the opening 503*a*, from a side of the container base portion 503 opposite to a side on which the pouch 501 is disposed. The container base portion 503 is joined to the nozzle 502 with an adhesive such as a hot-melt adhesive or by ultrasonic welding. The container base portion 503 includes claw portions 503*b* each serving as a shutter engaging portion that can be elastically displaced. In the present exemplary embodiment, the container base portion 503 and the nozzle 502 are separate components. Alternatively, the container base portion 503 may be integrally formed with the nozzle 502 and the opening 503*a* may also function as the discharge port 502*a*.

The container shutter 41 is supported by the container base portion 503 so as to be slidable (movable) with respect to the container base portion 503. The container shutter 41 includes groove portions 41*a* and pressing portions 41*b*. Each of the groove portion 41*a* serves as an engaged portion to be engaged with the corresponding claw portion 503*b* of the container base portion 503. Each of the pressing portions 41*b* protrudes from a surface of the container shutter 41 opposite to a surface facing the container base portion 503. The container shutter 41 is slidable between a closed position (first closed position) illustrated in FIGS. 4A and 4B and an open position (first open position) illustrated in FIGS. 4A and 5B. At the closed position, the discharge port 502*a* of the nozzle 502 (the opening 503*a* of the container base portion 503) is closed. At the open position, the discharge port 502*a* is opened.

The claw portions 503*b* of the container base portion 503 are configured to move between an engagement position and an engagement release position with respect to the groove portions 41*a* of the container shutter 41. At the engagement position, the claw portions 503*b* engage with the groove portions 41*a*. At the engagement release position, the engagement with the groove portions 41*a* is released. While the container shutter 41 is at the closed position, as illustrated in FIGS. 4A and 4B, the claw portions 503*b* of the container base portion 503 are at the engagement position. With this configuration, the container shutter 41 cannot be accidentally moved from the closed position to the open position when the user carries only the toner container 40, thereby preventing toner leakage.

The container seal 504 is formed of urethane foam, non-woven cloth, or the like, and is fixed by a fixing member, such as a double-sided adhesive tape, to an external surface of the container base portion 503 that faces the container shutter 41. The container seal 504 includes a hole 504*a* that is equal to or larger than the opening 503*a* of the container base portion 503. The opening 503*a* is exposed from the container seal 504 through the hole 504*a*. The hole 504*a* functions as a conveyance path through which the toner discharged from the discharge port 502*a* of the nozzle 502 passes. As illustrated in FIG. 4A, an end 504*b* of the container seal 504 in the direction in which the container shutter 41 is moved from the open position to the closed position sticks out from an end of the container shutter 41 at the closed position on the same side as that of the end 504*b*. The end 504*b* of the container seal 504 is exposed to the outside of the toner container 40.

The container sheet 505 is fixed by a fixing member, such as a double-sided adhesive tape, to a surface 41*c* (see FIG. 6) of the container shutter 41 that faces the container seal 504 fixed to the container base portion 503. As illustrated in FIG. 4A, an end 505*a* of the container sheet 505 in the direction in which the container shutter 41 is moved from the open position to the closed position sticks out from the end of the container shutter 41 on the same side as that of the end 505*a*, and is exposed to the outside of the toner container 40.

Toner Container Mounting Portion

Figure 7A:
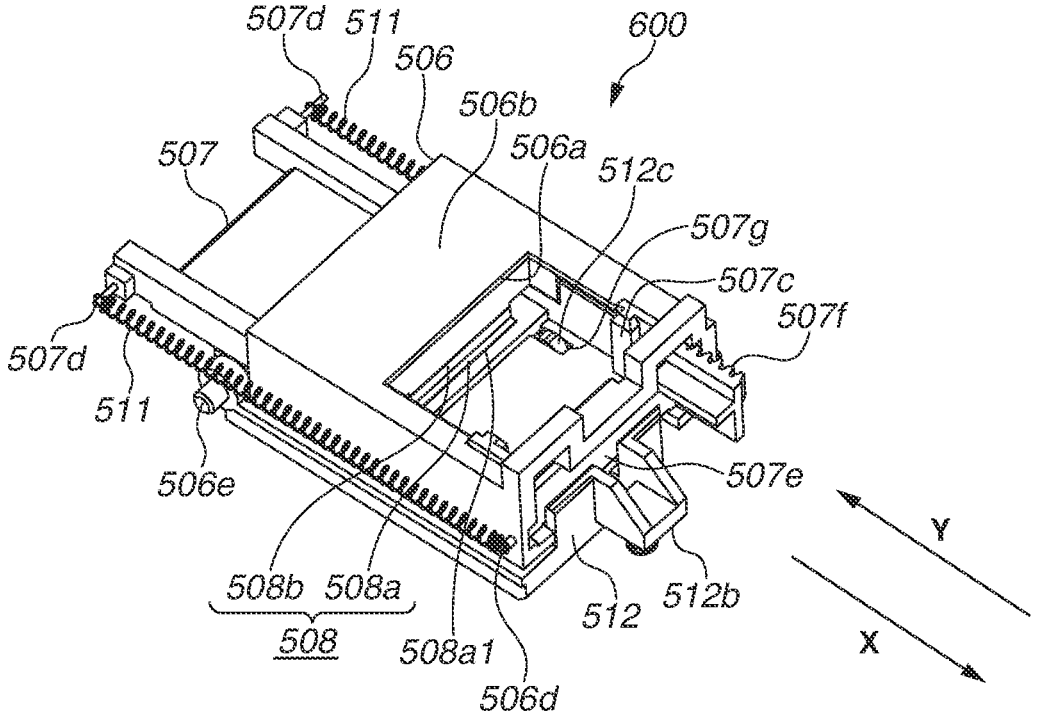
FIG. 7A is a perspective view illustrating a mounting portion viewed from a toner container side, according to one or more exemplary embodiment.
Figure 7B:
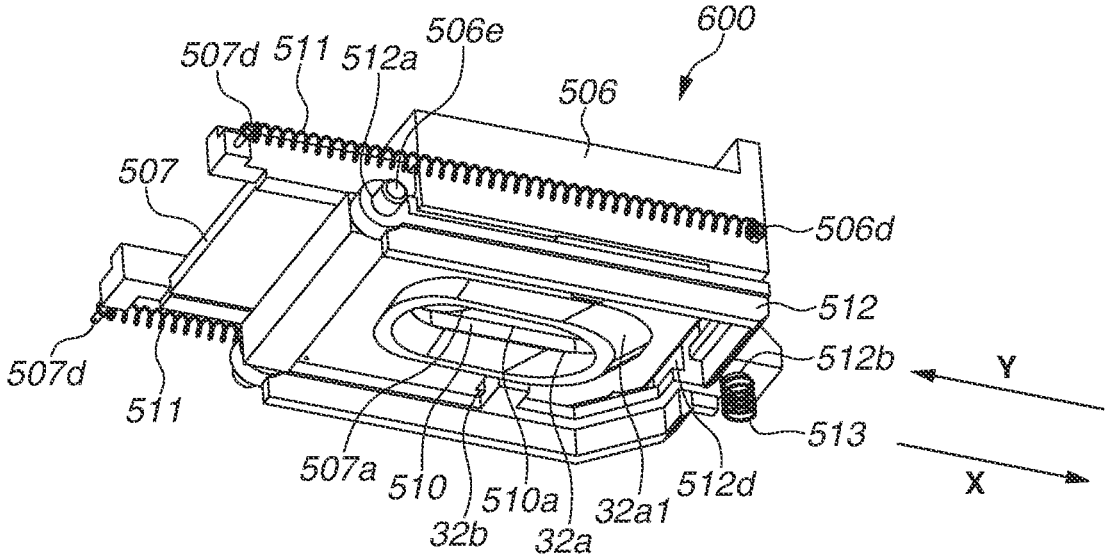
FIG. 7B is a perspective view illustrating the mounting portion viewed from a development container side, according to one or more exemplary embodiment.
Figure 8:
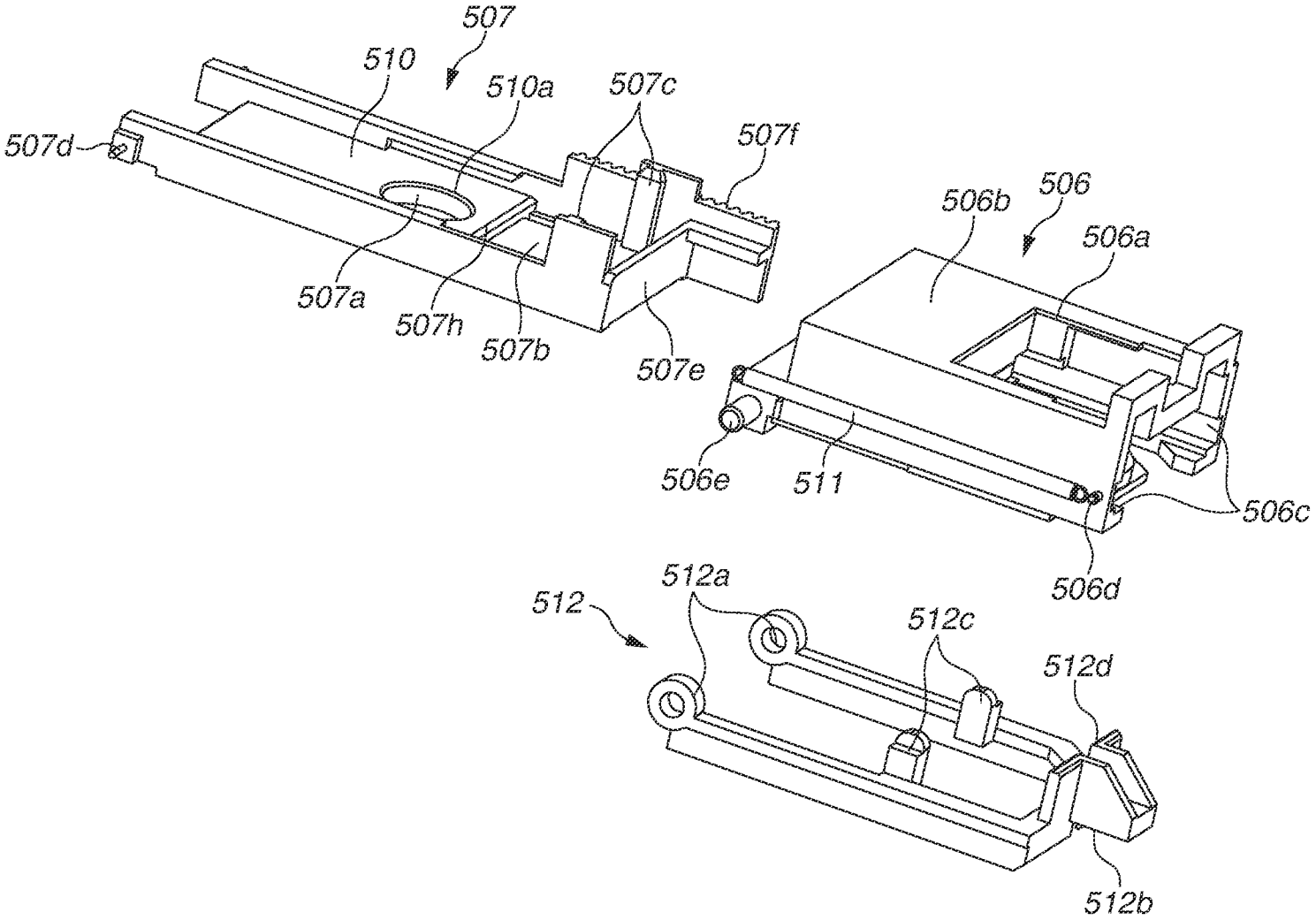
FIG. 8 is an exploded perspective view of the mounting portion, according to one or more exemplary embodiment.

The configuration of the mounting portion 600 that is a part of the development unit 30 will be described next. The mounting portion 600 is configured to detachably mount the toner container 40 thereon, and is integrally formed with the development container 32 as illustrated in FIG. 3 in the present exemplary embodiment. FIG. 7A is a perspective view illustrating the mounting portion 600 viewed from the toner container 40 side. FIG. 7B is a perspective view illustrating the mounting portion 600 viewed from the development container 32 side. FIG. 8 is an exploded perspective view of the mounting portion 600.

As illustrated in FIG. 8, the mounting portion 600 can be divided into a development base portion (main body base portion) 506, a development shutter (main body shutter) 507, and a regulating member 512. The development base portion 506 and the development shutter 507 are provided with a development base seal 508 and a development shutter seal 510, respectively.

Figure 9A:
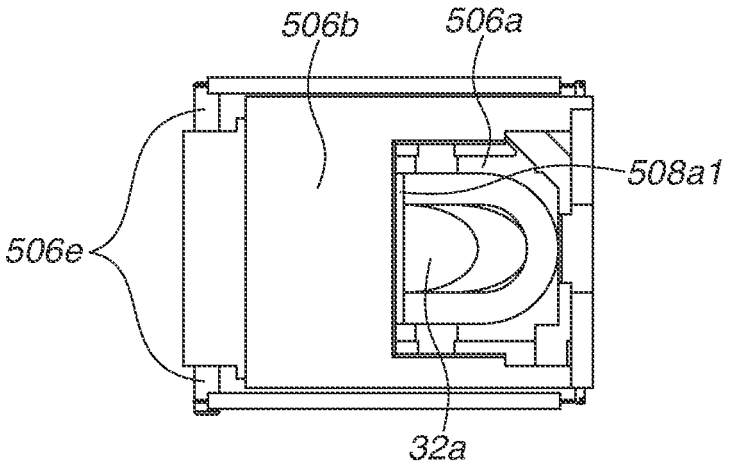
FIG. 9A is a view illustrating a development base portion viewed from the toner container side, according to one or more exemplary embodiment.
Figure 9B:
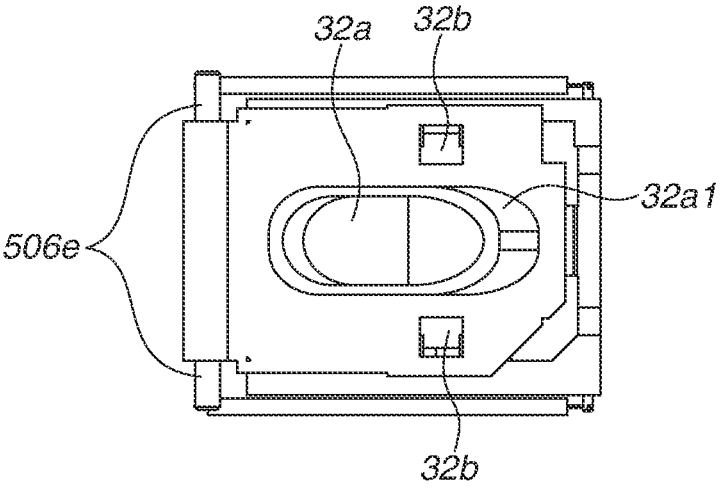
FIG. 9B is a view illustrating the development base portion viewed from the development container side, according to one or more exemplary embodiment.
Figure 10:
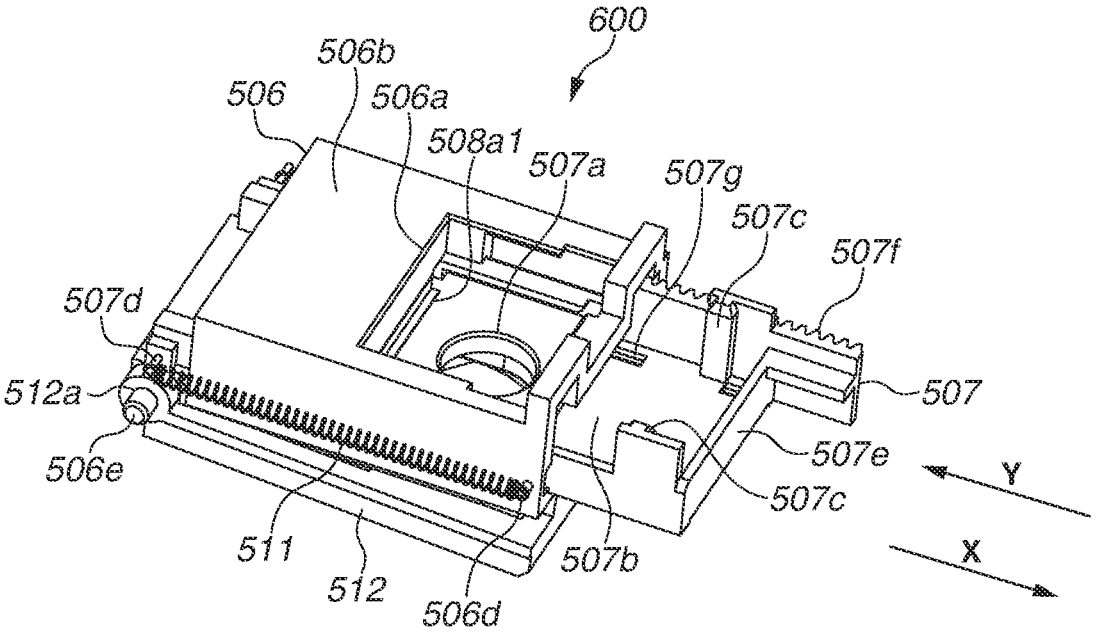
FIG. 10 is a perspective view illustrating the mounting portion in a state where a development shutter is at an open position, according to one or more exemplary embodiment.

As illustrated in FIG. 3, the development base portion 506 is connected to the development container 32 and can be divided into an upper portion and a lower portion. FIG. 9A illustrates the development base portion 506 viewed from the toner container 40 side (from above). FIG. 9B illustrates the development base portion 506 viewed from the development container 32 side (from below). FIG. 10 is a perspective view illustrating the mounting portion 600 in a state where the development shutter 507 is at an open position.

As illustrated in FIGS. 7A and 9A, the upper portion of the development base portion 506 is provided with an insertion opening 506*a* for inserting the container shutter 41 and the container base portion 503 of the toner container 40, and a base closing portion 506*b*.

As illustrated in FIGS. 7B and 9B, the lower portion of the development base portion 506 is provided with the supply port 32*a* that communicates with the toner containing portion 36 of the development container 32, and through-holes 32*b*. The supply port 32*a* is a receiving port that receives the toner discharged from the discharge port 502*a* of the toner container 40 in a state where the toner container 40 is mounted on the mounting portion 600. As illustrated in FIG. 9B, the supply port 32*a* is a long hole that is elongated in the direction in which the insertion opening 506*a* and the base closing portion 506*b* are arranged side by side, and overlaps both the insertion opening 506*a* and the base closing portion 506*b* when viewed from above. The direction in which the insertion opening 506*a* and the base closing portion 506*b* are arranged side by side coincides with the direction in which the development shutter 507 (described below) is slid (moved).

As illustrated in FIG. 8, the development base portion 506 further includes guide groove portions 506*c*, development base locking portions 506*d*, and a rocking shaft 506*e*.

As illustrated in FIG. 7A, the development base seal 508 is fixed to the inner surface of the base closing portion 506*b* of the development base portion 506 by a fixing member such as a double-sided adhesive tape. The development base seal 508 includes a surface layer 508*a* made of a film material with a thickness of 50 to 250 μm, and an elastic layer 508*b* formed of urethane foam, non-woven cloth, or the like. An end 508*a*1 of the surface layer 508*a* in an X-direction illustrated in FIG. 7A sticks out from an end of the elastic layer 508*b* on the same side.

The development shutter 507 includes a shutter opening 507*a* and a shutter closing portion 507*b*. The development shutter 507 is slidable (movable) in a sliding direction (X-direction or Y-direction) in an area between the upper portion of the development base portion 506 where the insertion opening 506*a* and the base closing portion 506*b* are provided and the lower portion of the development base portion 506 where the supply port 32*a* is provided. The development shutter 507 is supported by the development base portion 506 so as to be slidable between a closed position (second closed position or first position) illustrated in FIG. 7A and the open position (second open position or second position) illustrated in FIG. 10 with respect to the development base portion 506. The X-direction illustrated in FIGS. 7A and 7B coincides with the direction in which the development shutter 507 is moved from the closed position to the open position. The Y-direction coincides with the direction in which the development shutter 507 is moved from the open position to the closed position.

An end of the development shutter 507 in the direction orthogonal to the sliding direction is slidably guided (supported) by the guide groove portions 506*c* (see FIG. 8) located on the inside of a connecting portion that connects the upper portion and the lower portion of the development base portion 506.

Next, the open position and the closed position of the development shutter 507 will be described in detail. As illustrated in FIG. 10, the open position of the development shutter 507 is a position where the shutter opening 507*a* overlaps the insertion opening 506*a* and the supply port 32*a* of the development base portion 506 when the development shutter 507 is viewed from above. The closed position of the development shutter 507 is a position where the shutter closing portion 507*b* overlaps the supply port 32*a* and the shutter opening 507*a* overlaps the base closing portion 506*b* and the supply port 32*a* when the development shutter 507 is viewed from above.

While the development shutter 507 is at the open position, the toner containing portion 36 of the development container 32 can receive the toner discharged from the discharge port 502*a* of the toner container 40 through the supply port 32*a*. While the development shutter 507 is at the closed position, the supply port 32*a* of the development base portion 506 is closed by the shutter closing portion 507*b* so as to prevent the supply port 32*a* from being exposed from the insertion opening 506*a*, thereby preventing contamination of foreign matter or the like.

The development shutter seal 510 is fixed to a surface of the development shutter 507 that faces the base closing portion 506*b* and the insertion opening 506*a* of the development base portion 506 by a fixing member such as a double-sided adhesive tape. The development shutter seal 510 includes an opening 510*a* provided at a position corresponding to the shutter opening 507*a*. The development shutter seal 510 is configured so that, while the development shutter 507 is at the closed position, the development shutter seal 510 is in tight contact with the development base seal 508 of the development base portion 506 to prevent toner leakage in the vicinity of the shutter opening 507*a*.

The development shutter 507 further includes ribs 507*c* each serving as an engaging portion, shutter locking portions 507*d*, a regulated surface 507*e*, rack teeth 507*f* serving as a driving force receiving portion, a slope portion 507*h*, and through-holes 507*g*.

Mounting of Toner Container

Figure 11A:
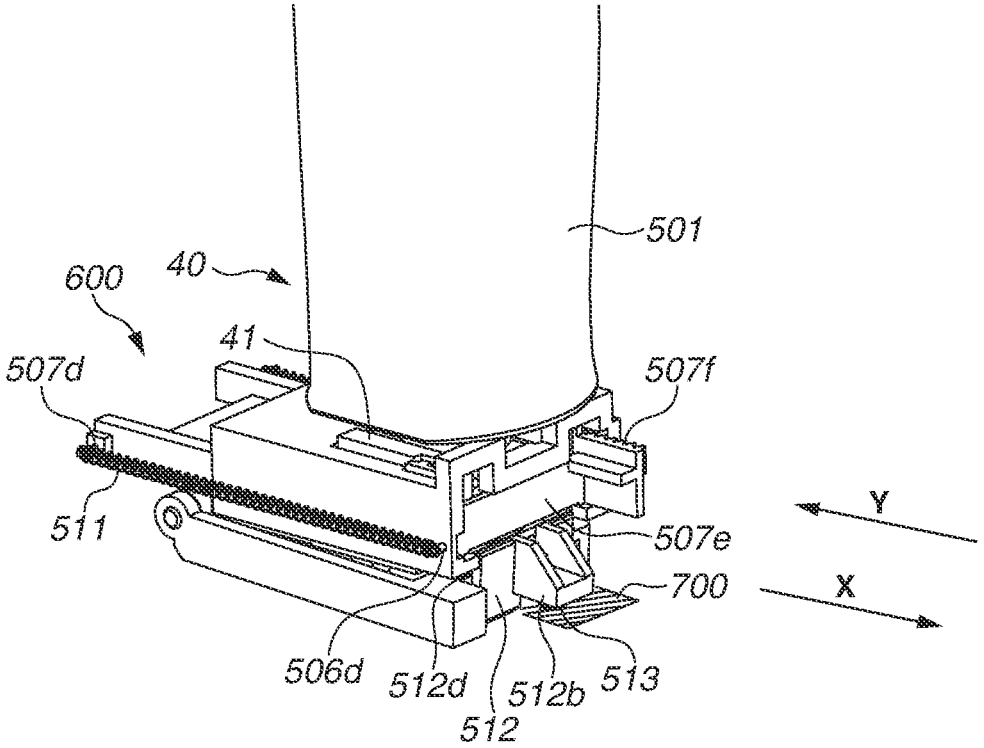
FIG. 11A is a perspective view illustrating the toner container and the mounting portion in a state where the mounting of the toner container on the mounting portion is completed and the development shutter is about to be moved from a closed position to the open position, according to one or more exemplary embodiment.
Figure 11B:
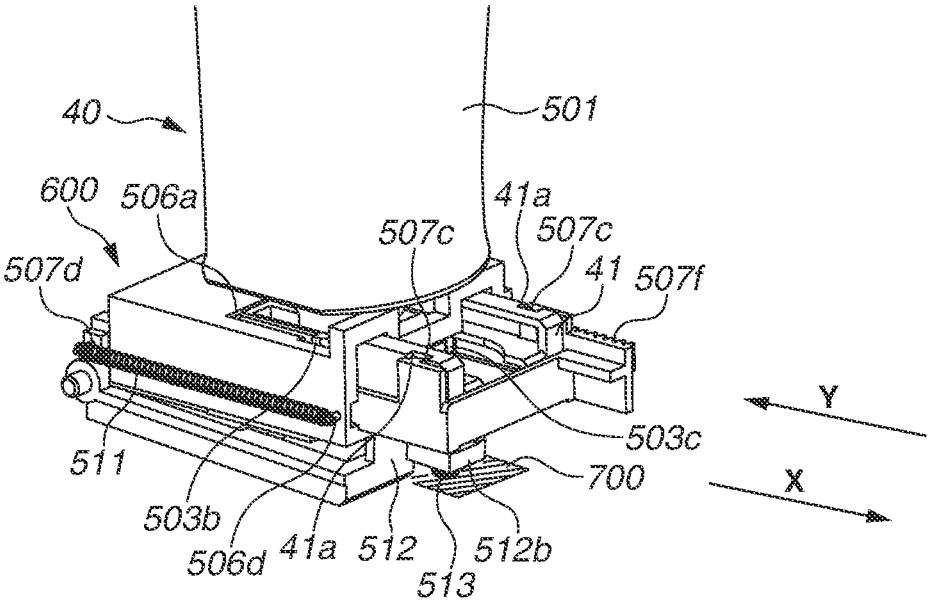
FIG. 11B is a perspective view illustrating the toner container and the mounting portion in a state where the mounting of the toner container on the mounting portion is completed and the development shutter is at the open position, according to one or more exemplary embodiment.

The mounting portion 600 has a mechanism for moving the development shutter 507 from the closed position to the open position when the toner container 40 is mounted on the mounting portion 600. This mechanism will be described next. FIG. 11A is a perspective view illustrating the toner container 40 and the mounting portion 600 in a state where the mounting of the toner container 40 on the mounting portion 600 is completed and the development shutter 507 is about to be moved from the closed position to the open position. FIG. 11B is a perspective view illustrating the toner container 40 and the mounting portion 600 in a state where the mounting of the toner container 40 on the mounting portion 600 is completed and the development shutter 507 is at the open position.

The mounting portion 600 includes tension coil springs 511 each serving as a first urging member. One end and the other end of each of the tension coil springs 511 in an expansion/contraction direction thereof are locked with the corresponding development base locking portion 506*d* of the development base portion 506 and the corresponding shutter locking portion 507*d* of the development shutter 507, respectively. The tension coil springs 511 urge the development shutter 507 in the direction in which the development shutter 507 is moved from the closed position to the open position with respect to the development base portion 506.

The regulating member 512 is configured to be moved between a regulation position (see FIGS. 7A and 7B) where the movement of the development shutter 507 from the closed position to the open position is regulated and a regulation release position (see FIGS. 10, 11A, and 11B) where the regulation of the movement of the development shutter 507 from the closed position to the open position is released. In the present exemplary embodiment, as illustrated in FIG. 8, the regulating member 512 includes rockably supported portions 512*a* that are rockably supported by the rocking shaft 506*e* of the development base portion 506, and is moved up and down around the rockably supported portions 512*a* between the regulation position and the regulation release position.

A regulating surface 512*d* of the regulating member 512 is in contact with the regulated surface 507*e* of the development shutter 507 while the regulating member 512 is at the regulation position as illustrated in FIGS. 7A and 7B, thereby regulating the movement of the development shutter 507 from the closed position to the open position. The regulated surface 507*e* is an end surface of the development shutter 507 in the direction in which the development shutter 507 is moved from the closed position to the open position. While the regulating member 512 is at the regulation release position as illustrated in FIG. 10, the regulating surface 512*d* of the regulating member 512 is retracted to avoid contact with the regulated surface 507*e* of the development shutter 507, thereby allowing the development shutter 507 to move from the closed position to the open position. The development shutter 507 is moved from the closed position to the open position by the force of the tension coil springs 511 when the regulating member 512 is located at the regulation release position.

The regulating member 512 is configured to be moved from the regulation position to the regulation release position when the toner container 40 is mounted on the mounting portion 600. More specifically, the regulating member 512 is at the regulation position in a state (first state) where the toner container 40 is not mounted on the mounting portion 600, and is at the regulation release position in a state (second state) where the mounting of the toner container 40 on the mounting portion 600 is completed.

As illustrated in FIGS. 11A and 11B, the mounting portion 600 includes a compression coil spring 513 serving as a second urging member. On end of the compression coil spring 513 in a compression direction thereof is supported by a spring support portion 512*b* of the regulating member 512. The other end of the compression coil spring 513 is supported by a spring support portion 700 provided at a portion of the mounting portion 600 not to be moved with the regulating member 512 or the development shutter 507. The compression coil spring 513 is compressed between the spring support portion 512*b* and the spring support portion 700 and urges the regulating member 512 in the direction in which the regulating member 512 is rocked (moved) from the regulation release position to the regulation position.

In a state where the toner container 40 is not mounted on the mounting portion 600, as illustrated in FIG. 7A, the regulating member 512 is located at the regulation position by the urging force of the compression coil spring 513. Accordingly, the development shutter 507 is regulated by the regulating member 512 and remains at the closed position. While the toner container 40 is being mounted on the mounting portion 600, the pressing portions 41*b* (see FIG. 4A) of the container shutter 41 press pressed portions 512*c* (see FIG. 7A) of the regulating member 512 that are exposed from the through-holes 507*g* of the development shutter 507, and press down the regulating member 512. Accordingly, the regulating member 512 is rocked (moved) from the regulation position to the regulation release position against the urging force of the compression coil spring 513, and the development shutter 507 is slid (moved) from the closed position to the open position by the urging force of the tension coil springs 511. The pressed portions 512*c* of the regulating member 512 illustrated in FIG. 8 are projecting portions that protrude toward the development shutter 507 (development base portion 506). While the regulating member 512 is at the regulation position, the pressed portions 512*c* penetrate the through-holes 32*b* of the development base portion 506 and are exposed from the through-holes 507*g* of the development shutter 507.

Next, the development shutter 507 functioning as a movable member that moves the container shutter 41 of the toner container 40 between the closed position and the open position in a state where the toner container 40 is mounted on the mounting portion 600 will be described. As illustrated in FIG. 7A, the development shutter 507 includes the ribs 507*c* each exposed from the insertion opening 506*a* of the development base portion 506 and serving as an engaging portion. When the front end of the toner container 40 is inserted into the insertion opening 506*a* of the mounting portion 600, the ribs 507*c* make contact with the claw portions 503*b* of the container base portion 503 that engage with the groove portions 41*a* of the container shutter 41, thereby causing the claw portions 503*b* to retract from the groove portions 41*a*. As illustrated in FIG. 11B, the ribs 507*c* engage with the groove portions 41*a* of the container shutter 41 in which space is made after the retraction of the claw portions 503*b* of the container base portion 503. Thus, the engagement between the claw portions 503*b* of the container base portion 503 and the groove portions 41*a* is released, thereby allowing the container shutter 41 to move with respect to the container base portion 503 and move with the development shutter 507. When the development shutter 507 is moved from the closed position (second closed position) to the open position (second open position), the development shutter 507 moves the container shutter 41 from the closed position (first closed position) to the open position (first open position). In addition, when the development shutter 507 is moved from the open position (second open position) to the closed position (second closed position), the development shutter 507 moves the container shutter 41 from the open position (first open position) to the closed position (first closed position).

Operation force for Mounting Toner Container on Mounting Portion

An operation force required for the user to mount the toner container 40 on the mounting portion 600 and open the development shutter 507 and the container shutter 41 is equal to a force required to move the regulating member 512 from the regulation position to the regulation release position. In this case, a frictional force generated between the rockably supported portions 512*a* of the regulating member 512 and the rocking shaft 506*e* of the development base portion 506 is referred to as a first frictional force, and a frictional force generated between the regulating surface 512*d* of the regulating member 512 and the regulated surface 507*e* of the development shutter 507 is referred to as a second frictional force. The required operation force is obtained by subtracting the weight of the toner container 40 from the sum of the urging force of the compression coil spring 513, the first frictional force, and the second frictional force. Accordingly, when the toner container 40 is mounted on the mounting portion 600, the operation force required for the user can be reduced as compared with a configuration in which the development shutter 507 and the container shutter 41 are manually opened.

In addition, in the present exemplary embodiment, when the toner container 40 is mounted on the mounting portion 600, there is no need to manually rotate or slide the toner container 40 in order to open the development shutter 507 and the container shutter 41. Accordingly, it is possible to prevent the pouch 501 of the toner container 40 from being squeezed and largely deformed.

Furthermore, in the present exemplary embodiment, the development shutter 507 and the container shutter 41 are opened by a single operation of moving the toner container 40 downward to mount the toner container 40 on the mounting portion 600, thereby achieving excellent operability.

Configuration for Detaching Toner Container from Mounting Portion

Figure 12A:
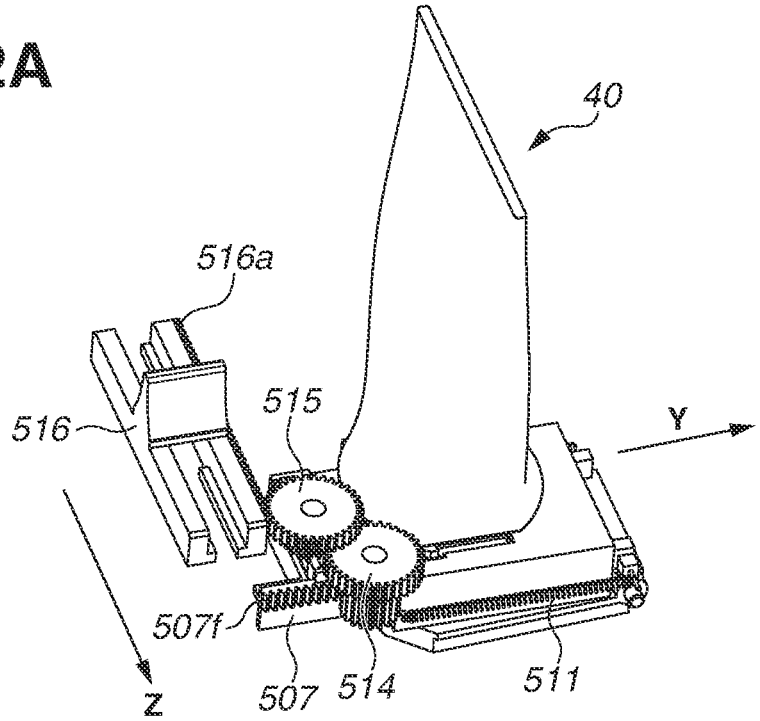
FIG. 12A is a perspective view illustrating a state where the toner container is mounted on the mounting portion and the development shutter is at the open position, according to one or more exemplary embodiment.
Figure 12B:
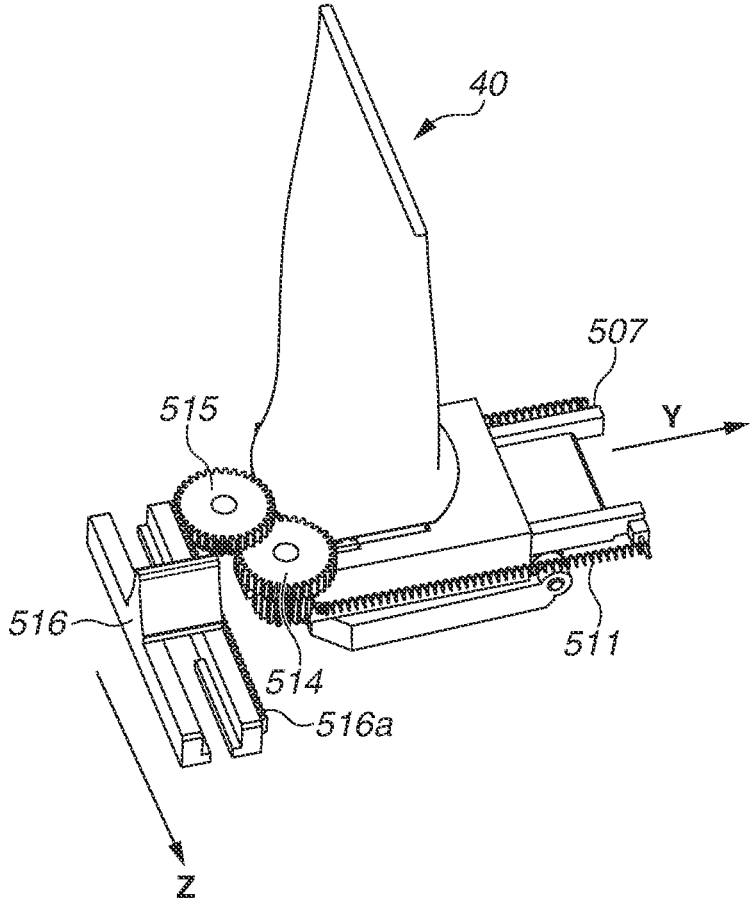
FIG. 12B is a perspective view illustrating a state where the development shutter is at the closed position and the toner container can be detached from the mounting portion, according to one or more exemplary embodiment.

A configuration and operation for detaching the toner container 40 from the mounting portion 600 will be described next. FIG. 12A is a perspective view illustrating a state where the toner container 40 is mounted on the mounting portion 600 and the development shutter 507 is at the open position where toner can be supplied. FIG. 12B is a perspective view illustrating a state where the development shutter 507 is at the closed position and the toner container 40 can be detached from the mounting portion 600.

The mounting portion 600 includes an operation lever 516 operated by the user to slide (move) the development shutter 507 from the open position to the closed position, and a first gear 515 and a second gear 514 each serving as a driving force transmission member.

When the operation lever 516 in the state illustrated in FIG. 12A is operated to move in a Z-direction, the development shutter 507 is slid in the Y-direction together with the container shutter 41, so that the toner container 40 illustrated in FIG. 12B can be detached from the mounting portion 600.

A mechanism for moving the development shutter 507 in conjunction with the movement of the operation lever 516 will now be described. The operation lever 516 includes rack teeth 516*a* serving as a driving force transmission portion. When the operation lever 516 is moved in the Z-direction, the first gear 515 that meshes (engages) with the rack teeth 516*a* is rotationally driven, and the second gear 514 that meshes with the first gear 515 is rotationally driven. Then, the rack teeth 507*f* of the development shutter 507 that mesh with the second gear 514 receive a driving force from the second gear 514, so that the development shutter 507 is moved in the Y-direction and reaches the closed position. When the development shutter 507 is moved in the Y-direction, the tension coil springs 511 are pulled and thus charged with a spring force. When the development shutter 507 reaches the closed position, the regulating member 512 is rocked from the regulation release position to the regulation position by the urging force of the compression coil spring 513, and the pressed portions 512*c* press the pressing portions 41*b* of the container shutter 41 to push the toner container 40 upward (see FIG. 7A). The movement of the development shutter 507 is regulated by the regulating member 512 located at the regulation position, and the development shutter 507 remains at the closed position. In this way, the toner container 40 can be detached from the mounting portion 600.

Toner Leakage Prevention Structure

A toner leakage prevention structure will be described with reference to FIGS. 13A to 13D that illustrate a change of state from when the toner container 40 is mounted on the mounting portion 600 to when the container shutter 41 of the toner container 40 and the development shutter 507 are opened.

Figure 13A:
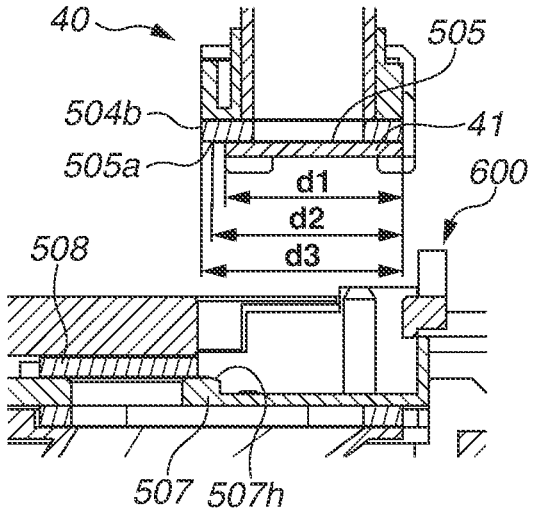
FIG. 13A is a sectional view illustrating the toner container and the mounting portion before the toner container is mounted on the mounting portion, according to one or more exemplary embodiment.

FIG. 13A is a sectional view illustrating the toner container 40 and the mounting portion 600 before the toner container 40 is mounted on the mounting portion 600. Assuming that the width of the container shutter 41 in the sliding direction thereof is represented by d1, the width of the container sheet 505 is represented by d2, and the width of the container seal 504 is represented by d3, the relation of d1<d2<d3 is satisfied. The end 504*b* of the container seal 504 and the end 505*a* of the container sheet 505 are exposed to the outside of the toner container 40.

Figure 13B:
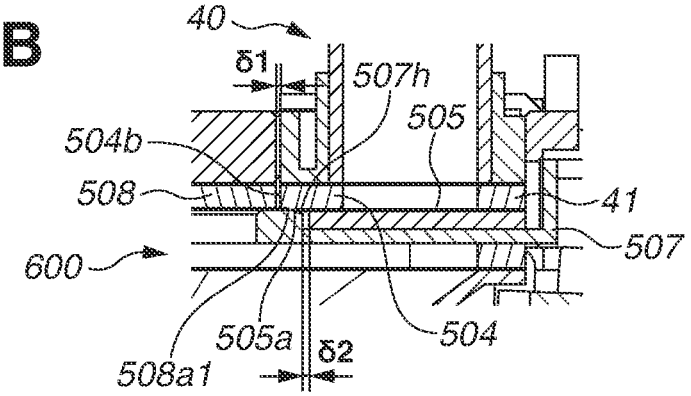
FIG. 13B is a sectional view illustrating the toner container and the mounting portion in a state where the toner container is mounted on the mounting portion and the container shutter and the development shutter at the closed position are about to be opened, according to one or more exemplary embodiment.

FIG. 13B is a sectional view illustrating the toner container 40 and the mounting portion 600 in a state where the toner container 40 is mounted on the mounting portion 600 and the container shutter 41 and the development shutter 507 at the closed position are about to be opened.

In this state, a gap δ1 is generated between the development base seal 508 and the container seal 504 due to design variations. To address this, a configuration is provided so that the end 504*b* of the container seal 504 overlaps and is in contact (tight contact) with the front end 508*a*1 of the surface layer 508*a* of the development base seal 508 when viewed along the mounting direction of the toner container 40. Accordingly, the gap δ1 is sealed from the outside of the toner container 40 and the mounting portion 600.

In addition, a gap δ2 is generated between the container shutter 41 and the development shutter 507 due to design variations. To address this, a configuration is provided so that, when the end 505*a* of the container sheet 505 is viewed along the mounting direction of the toner container 40, the end 505*a* overlaps the slope portion 507*h* at an end of the development shutter 507 in the direction from the closed position to the open position. Accordingly, the gap δ2 is sealed from the outside of the toner container 40 and the mounting portion 600.

Figure 13C:
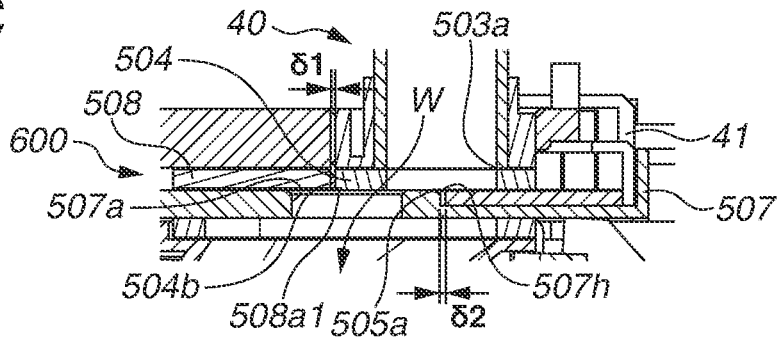
FIG. 13C is a sectional view illustrating the toner container and the mounting portion in a state where the toner container is mounted on the mounting portion and the development shutter is being slid from the closed position to the open position together with the container shutter, according to one or more exemplary embodiment.

FIG. 13C is a sectional view illustrating the toner container 40 and the mounting portion 600 in a state where the toner container 40 is mounted on the mounting portion 600 and the development shutter 507 is being slid from the closed position to the open position together with the container shutter 41. In this state, the opening 503*a* of the container base portion 503 communicates with the supply port 32*a* of the development base portion 506 through the shutter opening 507*a* of the development shutter 507, and toner is supplied to the development container 32 through a path indicated by an arrow W. As described above, since the gaps δ1 and δ2 are sealed, the entry of toner into the gaps δ1 and δ2 is prevented. Therefore, it is possible to prevent leakage of toner to the outside.

Figure 13D:
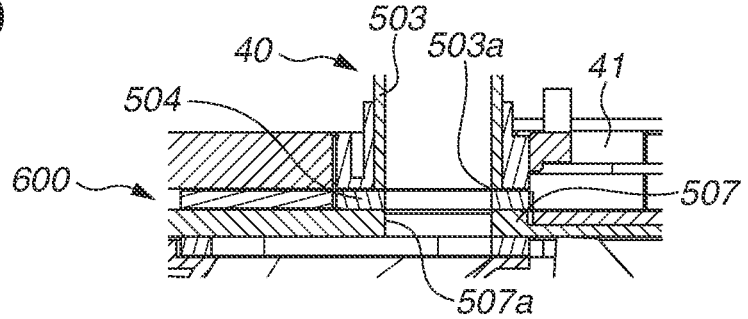
FIG. 13D is a sectional view illustrating the toner container and the mounting portion in a state where the toner container is mounted on the mounting portion and the development shutter and the container shutter are at the open position, according to one or more exemplary embodiment.

FIG. 13D is a sectional view illustrating the toner container 40 and the mounting portion 600 in a state where the toner container 40 is mounted on the mounting portion 600 and the development shutter 507 and the container shutter 41 are at the open position. The opening 503*a* of the container base portion 503 entirely overlaps the shutter opening 507*a* of the development shutter 507 when viewed along the mounting direction of the toner container 40. In this state, the user squeezes the pouch 501 of the toner container 40 with fingers or the like to supply the toner from the pouch 501 to the development container 32. The container seal 504 seals the periphery of the shutter opening 507*a* of the development shutter 507, thereby preventing toner leakage.

Countermeasure Against Scraped Off Toner

In the image forming apparatus 1, a remaining amount detection unit (not illustrated) detects a toner full state well in advance, for example, in a state where at least the amount of toner corresponding to one toner container 40 can be supplied to the toner containing portion 36 (see FIG. 3) of the development container 32. Furthermore, the image forming apparatus 1 is configured not to issue a toner supply request in a state where the toner full state is detected. However, if the user has supplied toner although the toner supply request has not been issued, the toner accumulated in the development container 32 may overflow and reach the shutter opening 507*a* of the development shutter 507. In this case, if the development shutter 507 is moved from the open position to the closed position, the toner that clogs in the shutter opening 507*a* is scraped off from the toner accumulated in the development container 32 and is moved with the development shutter 507. The toner that clogs in the shutter opening 507*a* and is moved with the development shutter 507 is hereinafter referred to as scraped off toner.

Figure 14:
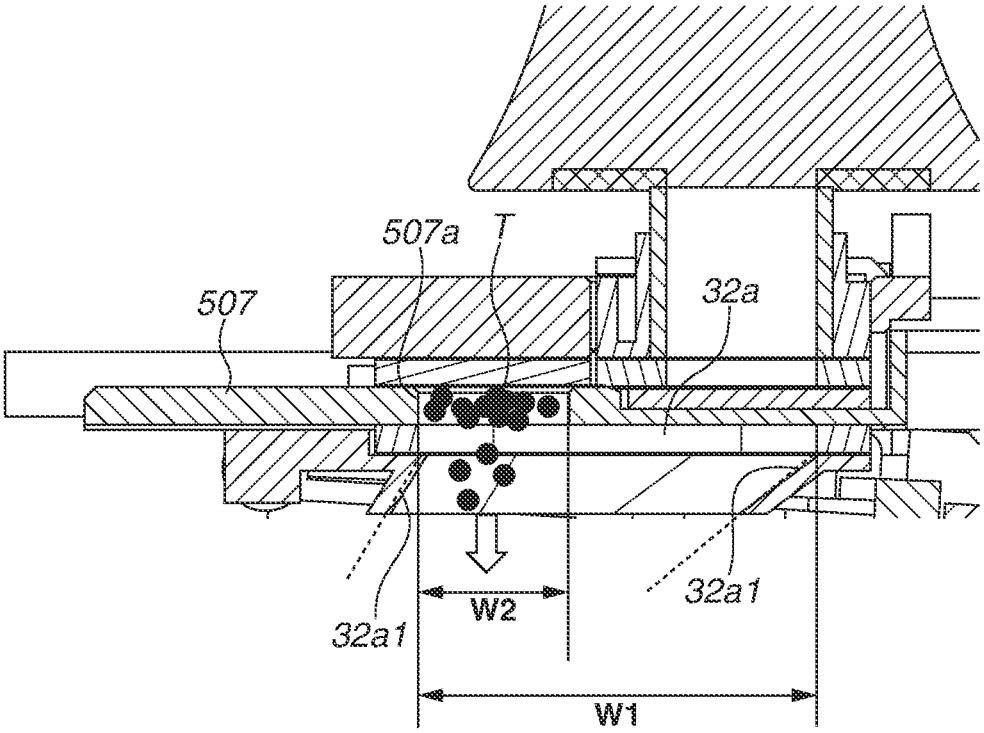
FIG. 14 is a sectional view illustrating the toner container and the mounting portion in a state where the development shutter has been moved to the closed position in a state where scraped off toner is present in a shutter opening, according to one or more exemplary embodiment.

FIG. 14 is a sectional view illustrating the toner container 40 and the mounting portion 600 immediately after the development shutter 507 is moved to the closed position in a state where scraped off toner T is present in the shutter opening 507*a*. As described above, the supply port 32*a* of the development base portion 506 is a long hole extending to a portion immediately below the shutter opening 507*a* of the development shutter 507 located at the closed position. The area of the shutter opening 507*a* having a width W2 is included in the area of the supply port 32*a* having a width W1. With this configuration, if the scraped off toner T that clogs in the shutter opening 507*a* is moved to the closed position, the scraped off toner T drops down toward the supply port 32*a* in a direction indicated by an arrow illustrated in FIG. 14, and thus is less likely to remain in the shutter opening 507*a*. As a result, scattering and leakage of toner due to the movement of the development shutter 507 can be prevented.

In addition, as illustrated in FIG. 14, a wall portion 32*a*1 that constitutes the supply port 32*a* is inclined. The wall portion 32*a*1 is gradually inclined downward in a direction from the supply port 32*a* to the stirring member 34 (see FIG. 3) of the toner containing portion 36 in the sliding direction of the development shutter 507. Thus, the toner supplied from the supply port 32*a* is moved along the wall portion 32*a*1 and drops down at a position near the stirring member 34.

In the present exemplary embodiment, the mounting portion 600 is configured as a part of the development unit 30. However, the configuration of the mounting portion 600 is not limited thereto. In a configuration in which toner is supplied from the toner container 40 to a toner hopper that is located at a position away from the development unit 30 and contains toner to be conveyed to the development unit 30, a mounting portion provided in the image forming apparatus 1 to mount the toner container 40 may be used.

In the present exemplary embodiment, the development shutter 507 that is movable so as to open or close the supply port 32*a* of the development base portion 506 is provided. However, the development shutter 507 is not limited to this configuration. Instead of using a shutter configured to move so as to open or close the supply port 32*a*, a cap that can be attached or detached by the user may be used. In this case, the development shutter 507 according to the present exemplary embodiment functions as a movable member for moving the container shutter 41 of the toner container 40.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. An image forming apparatus to and from which a toner container is attachable and detachable, the toner container including a first toner containing portion configured to contain toner therein, a discharge portion provided with a discharge port through which the toner contained in the first toner containing portion is discharged to outside of the toner container; and a container shutter configured to move, with respect to the discharge portion, between an open position where the shutter opens the discharge port and a closed position where the shutter closes the discharge port, the image forming apparatus comprising:

a second toner containing portion for containing the toner;

an attaching unit to and from which the toner container is attached and detached, the attaching unit including:

a base portion provided with a receiving port for receiving the toner discharged from the discharge port of the toner container, a movable member configured to move, with respect to the base portion, between a first position and a second position;

an urging member configured to urge the movable member in a direction from the first position to the second position, wherein by the toner container being attached to the attaching unit in a state that the movable member is in the first position, the movable member engages with the container shutter, and then moves with the container shutter from the first position to the second position by an urging force of the urging member, the container shutter being in the closed position when the movable member is in the first positon, the container shutter being in the open position when the movable member is in the second position.

2. The image forming apparatus according to claim 1, wherein the movable member is configured to move linearly between the first position and the second position.

3. The image forming apparatus according to claim 2, wherein the movable is configured to move in a direction crossing to an attaching direction of the toner container to the attaching unit.

4. The image forming apparatus according to claim 1, wherein the movable member is configured to close the receiving port when the movable member is in the first position, and to open the receiving port when the movable member is in the second position.

5. The image forming apparatus according to claim 1, further comprising: an operation member for an operation by which the movable member is moved from the second position to the first position against the urging force of the urging member, and wherein by the operation of the operation member, the container shutter is moved from the open position to the closed position.

6. The image forming apparatus according to claim 5, wherein the movable member is configured to move linearly between the first position and the second position in a first direction, wherein the operation member is configured to move linearly between a third position and a fourth position in a second direction crossing the first direction, and wherein when the operation member is in the third position, the movable member is in the first position, and the when operation member is in the fourth position, the movable member is in the second position.

7. The image forming apparatus according to claim 1, wherein the discharge portion of the toner container includes an restricting portion movable between a restricting position in which the restricting portion engages with a restricted portion of the container shutter so as to restrict the container shutter from being moved from the closed position to the open position, and a non-restricting position in which the restricting portion does not restrict the shutter from being moved from the closed position to the open position, wherein the attaching unit includes a restrict releasing portion configured to move the restricting portion from the restricting position to the non-restricting position when the toner container is attached to the attaching unit.

* * * * *